US011401709B2

(12) United States Patent
Stauffer et al.

(10) Patent No.: US 11,401,709 B2
(45) Date of Patent: Aug. 2, 2022

(54) BRICK TIE GAP CONNECTOR

(71) Applicant: Simpson Strong-Tie Company Inc., Pleasanton, CA (US)

(72) Inventors: Timothy M. Stauffer, Pleasant Hill, CA (US); Gary Lee Mochizuki, Walnut Creek, CA (US); Steven E. Pryor, Dublin, CA (US); Benedict Ang, Dublin, CA (US); Jin-Jie Lin, Livermore, CA (US); Paul Howard Oellerich, Pleasanton, CA (US)

( * ) Notice: Subject to any disclaimer, the term of this patent is extended or adjusted under 35 U.S.C. 154(b) by 0 days.

(21) Appl. No.: 16/177,117

(22) Filed: Oct. 31, 2018

(65) Prior Publication Data

US 2019/0127971 A1 May 2, 2019

Related U.S. Application Data

(60) Provisional application No. 62/627,625, filed on Feb. 7, 2018, provisional application No. 62/579,804, filed on Oct. 31, 2017.

(51) Int. Cl.
*E04B 5/00* (2006.01)
*E04B 1/41* (2006.01)

(52) U.S. Cl.
CPC ..... *E04B 1/4178* (2013.01)

(58) Field of Classification Search
CPC . E04B 2/44; E04B 2/30; E04B 1/7616; E04B 1/4178; E04B 1/40; E04B 1/2608; E04B 1/41; E04B 1/7629; E04B 1/7637; E04B 2001/405; E04B 2001/2684; E04C 5/168
USPC ..... 52/379, 712, 713, 565, 513, 562, 698, 52/383
See application file for complete search history.

(56) References Cited

U.S. PATENT DOCUMENTS

| | | | | |
|---|---|---|---|---|
| 1,505,871 A | | 8/1924 | Curtis | |
| 2,262,130 A | | 11/1941 | Bagley | |
| 2,724,960 A | | 11/1955 | Nelsson | |
| 3,359,701 A | * | 12/1967 | Schneller | E04B 1/41 52/712 |
| 3,389,525 A | | 6/1968 | Moody | |
| 4,417,431 A | | 11/1983 | Commins et al. | |

(Continued)

FOREIGN PATENT DOCUMENTS

| | | |
|---|---|---|
| EP | 0118176 A2 | 9/1984 |
| EP | 0 177 152 A2 | 4/1986 |

(Continued)

OTHER PUBLICATIONS

Simpson Strong-Tie, "FTC—Cavity Frame Tie—Technical Data Sheet", Feb. 21, 2016, p. 1, Simpson Strong-Tie Company, Tamworth, Staffordshire, United Kingdom.

(Continued)

*Primary Examiner* — Chi Q Nguyen
(74) *Attorney, Agent, or Firm* — James R. Cypher; Charles R. Cypher

(57) ABSTRACT

A sheet metal connector is provided for connecting a brick wall to a second structural member, the connector is received in the mortar joint of the brick wall and is connected to second structural member. The connector is provided with zones of controlled bending and controlled stiffness to allow for controlled bending of the connector in the field.

20 Claims, 20 Drawing Sheets

(56) References Cited

U.S. PATENT DOCUMENTS

| | | | | |
|---|---|---|---|---|
| 4,598,518 | A * | 7/1986 | Hohmann | E04B 1/4178 52/410 |
| 4,922,680 | A | 5/1990 | Kramer et al. | |
| 4,955,172 | A * | 9/1990 | Pierson | E04B 1/4178 52/379 |
| 5,299,403 | A * | 4/1994 | Fentz | E04B 1/7629 52/379 |
| 5,456,052 | A * | 10/1995 | Anderson | E04B 1/4185 52/379 |
| 5,816,719 | A * | 10/1998 | Palmer | B41J 17/04 400/120.01 |
| 6,212,841 | B1 | 4/2001 | Plume | |
| 7,225,590 | B1 * | 6/2007 | diGirolamo | E04B 1/4178 52/379 |
| 8,833,003 | B1 * | 9/2014 | Hohmann, Jr. | E04B 1/98 52/167.1 |
| 8,863,460 | B2 * | 10/2014 | Hohmann, Jr. | E04B 1/4178 52/379 |
| 9,932,740 | B2 * | 4/2018 | Farahmandpour | E04F 13/0853 |
| 10,876,285 | B1 | 12/2020 | Wigboldy et al. | |
| 2007/0011964 | A1 | 1/2007 | Smith | |
| 2008/0115439 | A1 | 5/2008 | Tamlyn | |
| 2015/0096243 | A1 * | 4/2015 | Hohmann, Jr. | E04B 1/7616 52/167.1 |
| 2015/0121792 | A1 * | 5/2015 | Spoo | E04B 1/4178 52/483.1 |
| 2017/0081838 | A1 * | 3/2017 | Hohmann, Jr. | E04B 1/043 |

FOREIGN PATENT DOCUMENTS

| | | | |
|---|---|---|---|
| EP | 0 183 362 | A2 | 6/1986 |
| EP | 1 584 763 | | 10/2005 |
| GB | 537624 | | 6/1941 |
| GB | 623344 | | 5/1949 |
| GB | 1103362 | | 2/1968 |
| GB | 2 063 329 | | 6/1981 |
| GB | 2 069 564 | A | 8/1981 |
| GB | 2 115854 | A | 9/1983 |
| GB | 2 131 848 | A | 6/1984 |
| GB | 2 131 858 | A | 6/1984 |
| GB | 2 143 554 | | 2/1985 |
| GB | 2 161 844 | A | 1/1986 |
| GB | 2 174 122 | A | 10/1986 |
| GB | 2 255 358 | | 11/1992 |
| GB | 2 376 029 | B | 6/2004 |
| GB | 2423532 | | 6/2010 |

OTHER PUBLICATIONS

Simpson Strong-Tie, "Catalog C-UK02", 2002, p. 54 (one page), Simpson Strong-Tie Company, Tamworth, Staffordshire, United Kingdom.

Simpson Strong-Tie, "Catalog C-UK2020", 2020, p. 170 (one page), Simpson Strong-Tie Company, Tamworth, Staffordshire, United Kingdom.

Patent Cooperation Treaty (PCT), The International Search Report of the International Searching Authority, PCT/US2018/058557, dated Jan. 11, 2019, 2 pages, International Searching Authority, US Patent Office, Alexandria, VA.

Patent Cooperation Treaty (PCT), Written Opinion of the International Searching Authority, PCT/US2018/058557, dated Jan. 11, 2019, 6 pages, International Searching Authority, US Patent Office, Alexandria, VA.

Sabrefix, "Timber Frame Tie—Timber Frame—Technical Data Sheet", Jun. 2007, p. 1, Sabrefix, Watton, Norfolk, United Kingdom.

Heckman Anchors, Non-Adjustable Anchors for Masonry, 2010, p. 1, Hechman Anchors, , US.

Rob Thallon, Graphic Guide to Frame Construcion—Details for builders and designers, 1991, 3 pages, The Taunton Press, Newton, US.

Catnic, Catnic Cavity Wall Ties, Nov. 1991, 4 pages, Catnic, United Kingdom.

Cullen Building Products, FT—Wall Tie, Cullen Timber Engineering Connectors, 2009, pp. 42, 43, 6, front and back covers, Cullen Building Products, United Kingdom.

Ceram Building Technology, Ceram Building Technology United Kingdom, Summary Report, Tests on the Simpson Strong-Tie BTS4 Timber Frame Wall Ties to BS EN 846-6, 1 page.

* cited by examiner

BRICK TIE GAP CONNECTOR

BACKGROUND OF THE INVENTION

The invention relates to a connector, typically called a brick tie, for making a connection between a brick wall and a structural wall or member located in the interior of the building behind the brick wall.

Generally, the brick wall is a non-structural veneer and the brick wall is spaced a selected distance from the structural wall. Most brick ties used to anchor a brick wall to a structural frame have an attachment portion that is received in the mortar joint between the bricks of the wall, a bridge or extending portion that is generally extends in line with the brick wall attachment portion and a portion that is attached to the structural framing behind the brick wall. Typically, the brick tie is bent between the bridge portion and the structural member attachment portion as the attachment portion received in the mortar joint is disposed horizontally in the mortar joint and the structural member attachment portion interfaces with and attaches to a vertically disposed surface of the structural framing.

Most brick ties are used to hold the brick wall in the correct spaced relationship with the structural wall behind it. The brick ties are intended to support the brick veneer wall against out of plane loads. The loads imposed on the brick wall can be directed toward and away from the structural framing. Thus the brick ties can be loaded in both tension and compression. Typically, brick ties are made of metal such as galvanized sheet steel. If the brick tie is meant to be bent in the field, then it is typically made of thin sheet steel that can be bent by hand. It is very common to construct the structural framing wall first, including applying a covering member such as waterproofing paper that protects against water intrusion into the building. This covering is typically fastened to the structural framing with nails, and often the installer fastens the brick ties to the structural framing at the same time that they apply the covering so a single fastener serves to both attach the covering and the brick tie to the wall. This reduces the number of fasteners that penetrate the covering. As the brick wall is built up in front of the structural wall the brick ties are field bent to have their portions extending from the structural framing received in the mortar joint between the bricks.

While brick ties can be made that are not designed to be bent in the field, many installers prefer to use brick ties that can be field bent for two reasons. This is particularly true when the structural framing is built first and the brick wall is built afterward. First, if the brick tie can be installed flat against the structural wall or close to the structural wall initially and then bent out from the wall when needed, it is less likely to interfere with the construction of the brick wall and it prevents less of a hazard to workers. Second, it can be difficult to measure precisely where the mortar joint between bricks will occur along the height of the structural wall, thus it is desirable to be able to adjust the height of the mortar joint attachment portion of the brick tie by field bending the tie.

However, it can be difficult to achieve good performance in tension and compression loading with brick ties that can be bent to varying degrees by the user. With typical brick ties that can be field bent both the location and the radius of the bend can vary greatly, and both affect performance. When the brick tie is loaded in tension, it is important for the location of the fastening of the brick tie to the structural wall to be close to the portion of the brick tie that extends to the brick wall. Generally as the distance between the fastening point and the portion that extends to the brick wall increases, the performance of the connection decreases. When the brick tie is loaded in compression, it is important for the radius of the bend between the brick wall attachment portion and the structural wall attachment portion to be small. In the case of a very small bend radius, the end of the brick wall attachment portion or the bridge portion nearly bears directly on the face of the structural wall and the brick tie performs well. If the bend radius is large, the bearing of the brick wall attachment portion or the bridge portion on the structural wall is offset from the forces acting on the brick wall attachment portion, resulting in lower performance. Thus it is important to have a small radius bend between the structural wall attachment portion and the portion of the brick tie extending from the structural wall and for the bend between the two to be located close to the fastening point of the structural attachment portion to the structural wall.

There are many patented and un-patented brick ties. U.S. Pat. No. 908,310 invented by T. J. McDonald and granted in 1908 and U.S. Pat. No. 1,076,836 invented by O. F. Merwin and granted in 1913 teach brick ties made from sheet metal that are designed to be bent in the field. They have corrugated or perforated sections that are received in the mortar joint. These ties also have planar sections that can be attached to a wooden structural wall. The planar sections of the ties are designed to be bent to attach to the vertically disposed surface of the wall.

U.S. Pat. No. 863,919 invented by W. V. Heinz and granted in 1907 teaches a sheet metal brick tie that has swaged portions that create projections that can be received in the mortar joint. In addition, the brick tie also has a middle portion with a long ridge or projection that makes the middle portion stiffer than the brick wall attachment portion. According to Heinz the ability of the connector to bear longitudinal strain is also improved by forming the margins of the connector in the brick wall attachment portion as straight, non-crimped members.

U.S. Pat. No. 1,505,871, granted to L. E. Curtis in 1924 teaches a brick tie made from sheet steel that has a main body portion made up of a generally planar portion arranged intermediate of two corrugated portions. On the margins of the main body portion are provided marginal sinuous strands connected at intervals along the main body portion. The marginal sinuous strands are arranged along the main body so that it is easy to bend the brick tie at the center when the brick tie will be attached to a wooden wall.

U.S. Pat. No. 6,212,841, invented by John Robert Plume and granted in 2001 teaches a plastic brick tie with a small bend radius and a fastening point located near the portion that extends to the brick wall. Plume's plastic brick tie is not meant to be field bent, but the plastic tie provides some flexture or flexing of the connector. According to Plume, his brick tie can be attached to the structural wall before the installer begins laying the brick of the brick wall, but the position in which to nail the brick-tie must be pre-measured, fairly accurately.

The present invention provides a brick wall connector that is simple to manufacture and can be bent in the field easily while still providing strong resistance to tension and compression loads.

SUMMARY OF THE INVENTION

It is an object of the present invention to provide a connection between a brick wall and a structural wall or member behind or closely adjacent the brick wall. It is a further object to provide a connection that resists tension and compression loading. It is a further object of the present invention to provide a connection that is easily adapted to present building practices.

The present invention is a connection between a brick wall and a structural member. The connection is made with a connector and a first fastening and a second fastening. The connector can be received in the mortar joint of the brick wall and attached to the structural member by a fastener. Where the connector is received in the mortar joint, the connector is preferably made with openings that can receive the mortar. Where the connector is received in the mortar joint, the connector is also preferably formed with rolled or crimped portions to further engage the mortar. The portion of the connector received in the mortar joint is called the mortar joint attachment portion. The connector also has a structural member attachment portion where the connector is attached to the structural member. When installed, the connector is typically formed with a bend at the end of the main body of the structural attachment portion. An extending portion extends away from the structural attachment portion at this bend. The extending portion includes the mortar joint attachment portion and can also include a bridge portion that bridges the gap between the brick wall and the structural member.

According to the present invention, the connector is made from relatively thin sheet steel and formed in such a manner that allows at least some bending of the connector by hand. The connector has a longitudinal axis that extends along the connector from the mortar joint attachment portion to the structural member attachment portion. The connector is designed to be bent transverse to the longitudinal axis.

According to the present invention, the connector is made with portions along the longitudinal axis that have embossments, or flanges, or non-flat portions or some combination thereof to strengthen selected portions of the connector, forming controlled stiffness zones. Similarly, other portions along the longitudinal axis of the connector have material removed and/or no strengthening flanges or no such strengthening portions so the connector is relatively weaker in that area along the longitudinal axis compared to the controlled stiffness zones. This allows for bending of the connector in these zones. These portions are called controlled bending zones. In forming the connector in this manner, the location and the radius of the field bends can be controlled. The radius of the field bends can be made quite small if the controlled bending zone between zones of controlled stiffness is quite small. Preferably, a controlled bending zone is located between the structural wall attachment portion and the extending portion of the connector. At the same time, at least one fastening of the structural member attachment portion to the structural member is provided close to or at the bend so that there is minimal offset between the fastening location of the structural member attachment portion and the bend between the structural member attachment portion and the extending portion.

According to the present invention, the connector can be formed with a fastener opening in the structural member attachment portion that lies on or is closely adjacent to the bend between the extending portion and the structural wall attachment portion. The extending portion can be made up of a bridge portion and mortar joint attachment portion. By placing the members in this manner eccentricity is removed between the line of action of the fastener and the line of action of the generally horizontally oriented extending portion of the connector.

According to the present invention, the connector is also formed with one or more calibrated stiffness zones. These calibrated stiffness zones are preferably located between the mortar joint and the structural wall. The calibrated stiffness zones are like the controlled bending zones in that they are designed to allow field bending of the connector in the calibrated stiffness zone. The calibrated stiffness zones are different from the controlled bending zones because they are formed with some stiffening members. The stiffening members are calibrated to carry an imparted load while still permitting controlled bending of the connector in the field at the calibrated stiffness zone. The stiffening member in the calibrated stiffness zone is designed to forestall the formation of a hinge when the part is loaded in tension or compression as compared to a simple area of controlled bending that lacks the addition of a stiffening member of calibrated stiffness. The calibrated stiffness zone is bracketed by areas of controlled stiffness along the longitudinal access that have more stiffening elements than the zone of calibrated stiffness thus any bending due to manipulation by the installer should occur in the calibrated stiffness zone. The stiffening element of the calibrated stiffness zone extends into the controlled stiffness zones that bracket the calibrated stiffness zone.

According to one embodiment of the present invention, the bridging member portion is formed with a large v-shaped embossment to strengthen this portion that is not inserted in the mortar joint or attached to the structural member. Typically, the connector will be installed with the vertex of the "v" of the embossment disposed upwardly and the sides of the v-shaped embossment extending downwardly. The orientation of the v-shaped embossment allows the bridge portion to shed water that may fall on the connector. The v-shaped embossment is preferably formed with weep holes or openings in the connector that allow water to drain from the v-shaped embossment when the connector is installed in an inverted position.

According to the present invention, the mortar joint attachment portion is preferably made with a plurality of generally parallel, thin extending embossments that extend along the length of the axis of the connector. The mortar joint attachment portion is also provided with openings for creating interlock with the mortar of the mortar joint. The extending embossments, of which there are three preferably, are disposed closer to the structural wall attachment portion then the interlocking openings. Portions of these extending embossments can protrude from the mortar joint in certain installations when the gap between the brick wall and the structural member are spaced farther apart than typically, or if the connector is bent substantially to have the mortar joint attachment portion reach into the mortar joint. These embossments provide strength to any portion of the mortar joint attachment portion that is not embedded in the mortar.

According to the present invention, the extending embossments in the mortar joint attachment portion at their ends closer to the structural attachment portion are preferably joined together by one or more angled transitioning embossments that come together to form one or more connecting embossments, preferably just one, that extend along the axis of the connector from the mortar joint attachment portion to the bridge portion of the extending portion. These one or more connecting embossments that extend from the mortar joint attachment portion to the bridge portion of the extending portion are preferably fewer in number than the extending embossments in the mortar joint attachment portion. These one or more connecting embossments also extend into the bridge portion that is formed with strengthening embossments or bends. This creates a calibrated stiffness zone between the mortar joint attachment portion and the bridge portion of the extending member. The one or more connecting embossments and the one or more extending embossments can be the same number, but the one or more connecting embossments and the one or more extending embossments in the mortar joint attachment portion are formed such that it is easier to bend the connector transverse to the axis along the connector at the calibrated stiffness zone between mortar joint attachment portion and the bridge portion. The one or more connecting embossments and the strengthening formations in the bridge portion are formed such that it is easier to bend the connector transverse to the axis along the connector at the calibrated stiffness zone between mortar joint attachment portion and the bridge portion.

According to the present invention, the extending embossments in the mortar joint attachment portion are connected by the one or more transitioning embossments to the one or more connecting embossments, and the one or more connecting embossments extend into the v-shaped embossment in the bridge portion. This connection of the embossments creates a gutter system that will transfer water off of the part via the weep holes in the v-shaped embossment if the part is disposed in an inverted position.

The particular elements used to strengthen the connector and give the connector its characteristic properties also allow the connector to be made with less material which reduces the cost of the connector. These elements include making the bridge portion with a single v-shaped embossment that extends the width of the connector, making the mortar joint attachment portion with three parallel thin embossments and making the mortar joint attachment potion with rimmed openings.

DESCRIPTION OF THE PREFERRED EMBODIMENT

Figure 9:
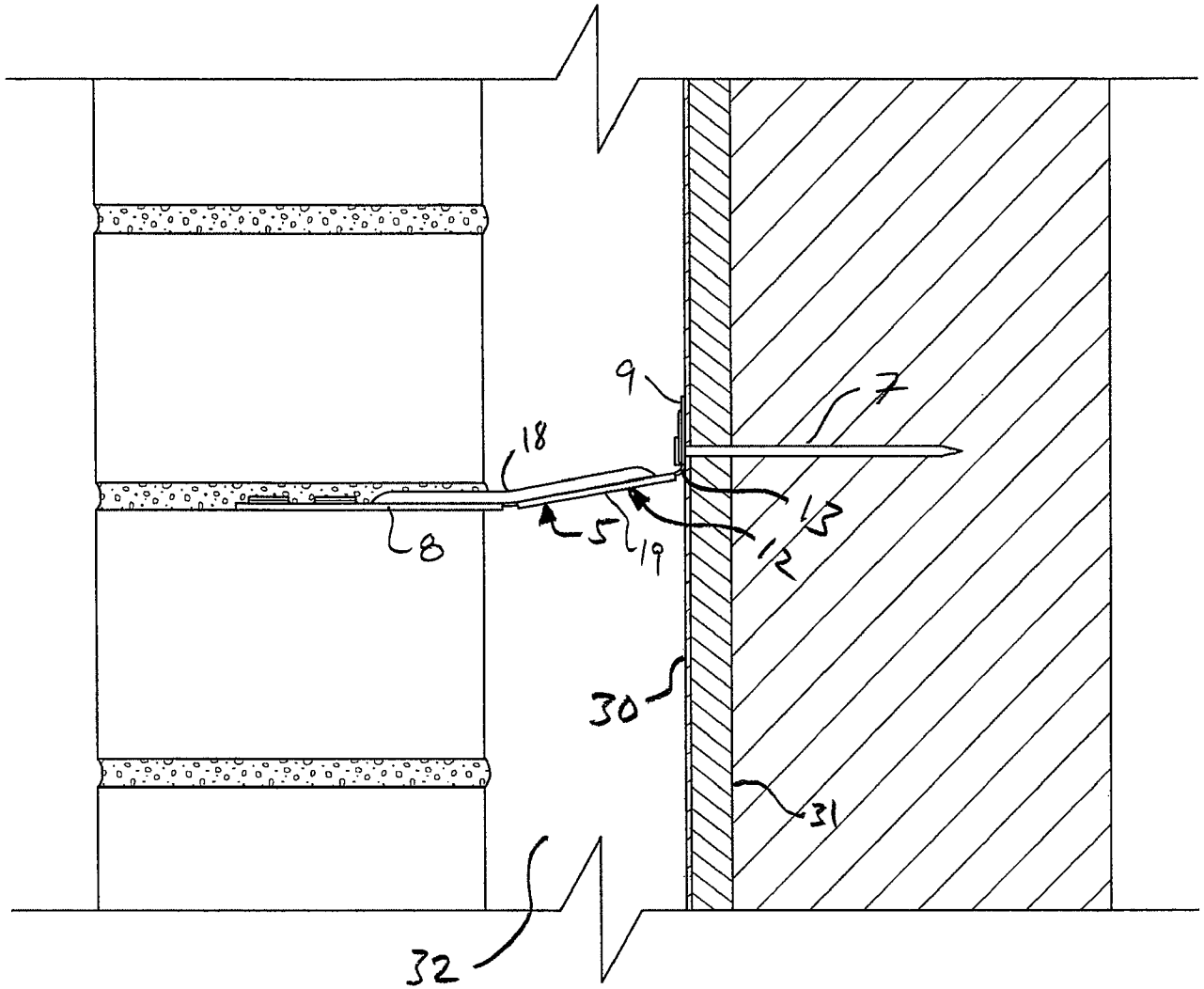
FIG. 9 is a side, cross-sectional view of the connection of the present invention, showing the connector bent into an alternate shape as in FIG. 2.

The present invention is a connection between a wall 1 such as a brick wall where elements are joined by mortar and a structural member 2. The connection is designed to resist tension and compression loading between the brick wall 1 and the structural wall 2. Preferably, the brick wall 1 has a mortar 3 joint which can serve as a first fastening, and the second member has a vertically disposed attachment surface 4. As shown in FIG. 9, in one preferred embodiment of the invention, the mortar joint 3 and the attachment surface 4 are disposed generally orthogonally. The brick wall 1 and the structural member 2 are positively joined by the brick tie or connector 5 of the present invention.

The structural member 2 is typically made from wood, but could also be any building material used to create the structural frame of a building or wall such as steel. The structural member 2 can also be a cementitious member or another wall built out of elements joined by mortar.

Figure 1:
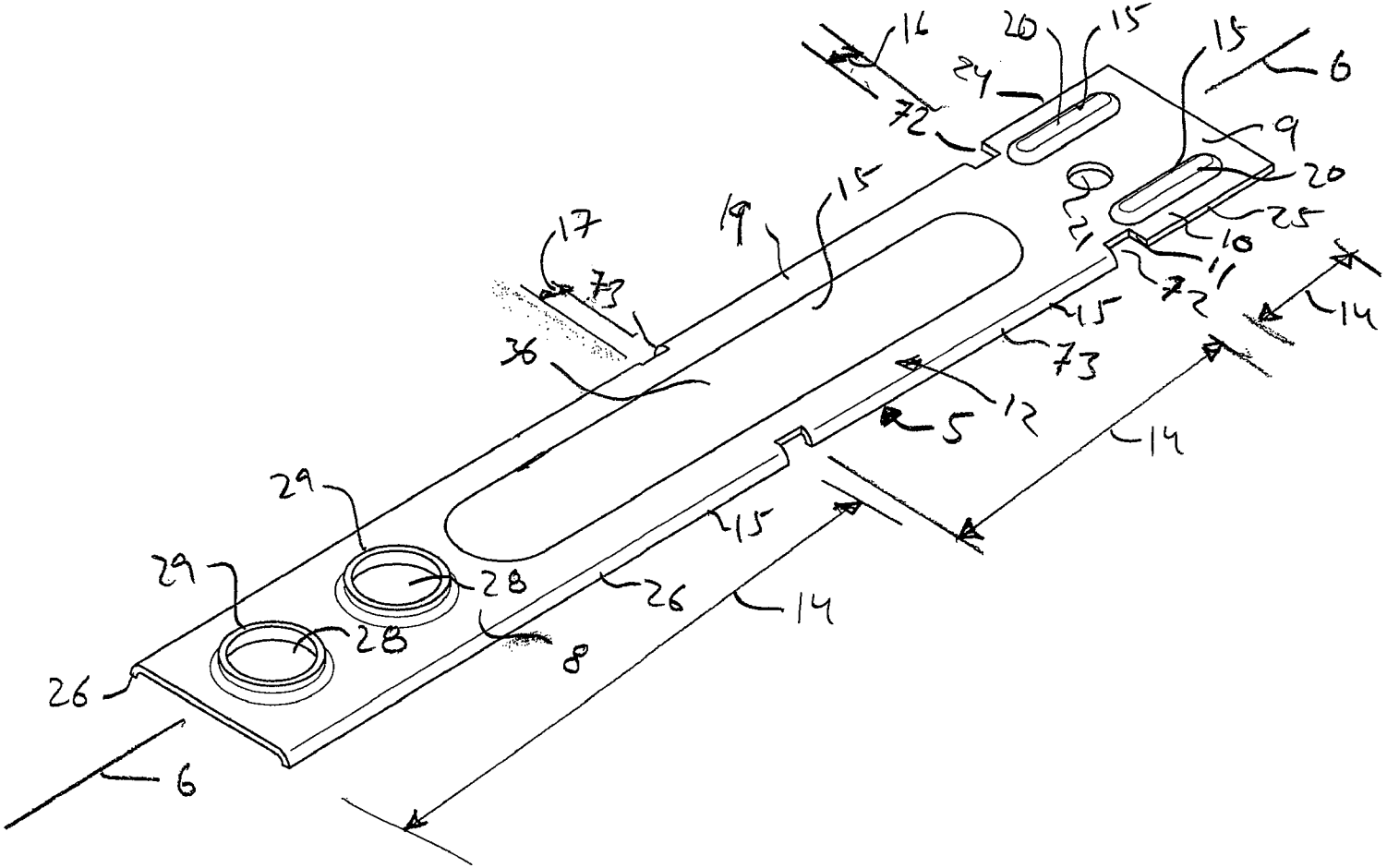
FIG. 1 is a perspective view of a connector according to the present invention.

In order to better define the invention the connector 5 is described as having a longitudinal axis 6 as shown in FIG. 1. As shown in FIG. 9, a first preferred embodiment of the connection of the present invention used to join the brick wall 1 and the structural wall or structural member 2 also includes one or more fasteners 7 received by the elongated connector 5 and the structural member 2.

The elements of the connection are preferably arranged in the following manner. The connection 5 is formed with the wall 1 having the mortar joint 3 and the structural member 2 having a substantially vertically disposed surface 4. The connector 4 has a mortar joint attachment portion 8 received in the mortar joint 3 of the wall 1 and a structural member attachment portion 9 that interfaces with and is attached to the substantially vertically disposed surface 4 of the structural member 2, the structural member attachment portion 9 has a main body 10 and at the end 11 of the main body 10 the structural member attachment portion 9 is joined to an extending portion 12 at a first bend 13. The extending portion 12 extends away from the substantially vertically disposed surface 4 of the structural member and extends to the wall 1 having the mortar joint 3, the extending portion 12 includes the mortar joint attachment portion 8. As noted above, the connector 5 has a longitudinal axis 6 that extends along the mortar joint attachment portion 8 and to and along the structural member attachment portion 9. The connector 5 also includes one or more controlled stiffness zones 14 where the connector 5 is formed with strengthening portions 15, one or more controlled bending zones 16 where the connector 5 is adapted to be more easily bent transversely to the longitudinal axis 6 than the connector 5 can be bent transversely to the longitudinal axis 6 in the controlled stiffness zones 14, and one or more calibrated stiffness zones 17 where the connector 5 can be bent more easily than the connector 5 can be bent in the controlled stiffness zones 14 transversely to the longitudinal axis 6 and where the connector 5 can be bent less easily than in the controlled bending zones 16 transversely to the longitudinal axis 6.

In FIG. 1, the connector 5 is shown before it has been attached to the structural member 2 and before it is has been bent in the field.

Figure 2:
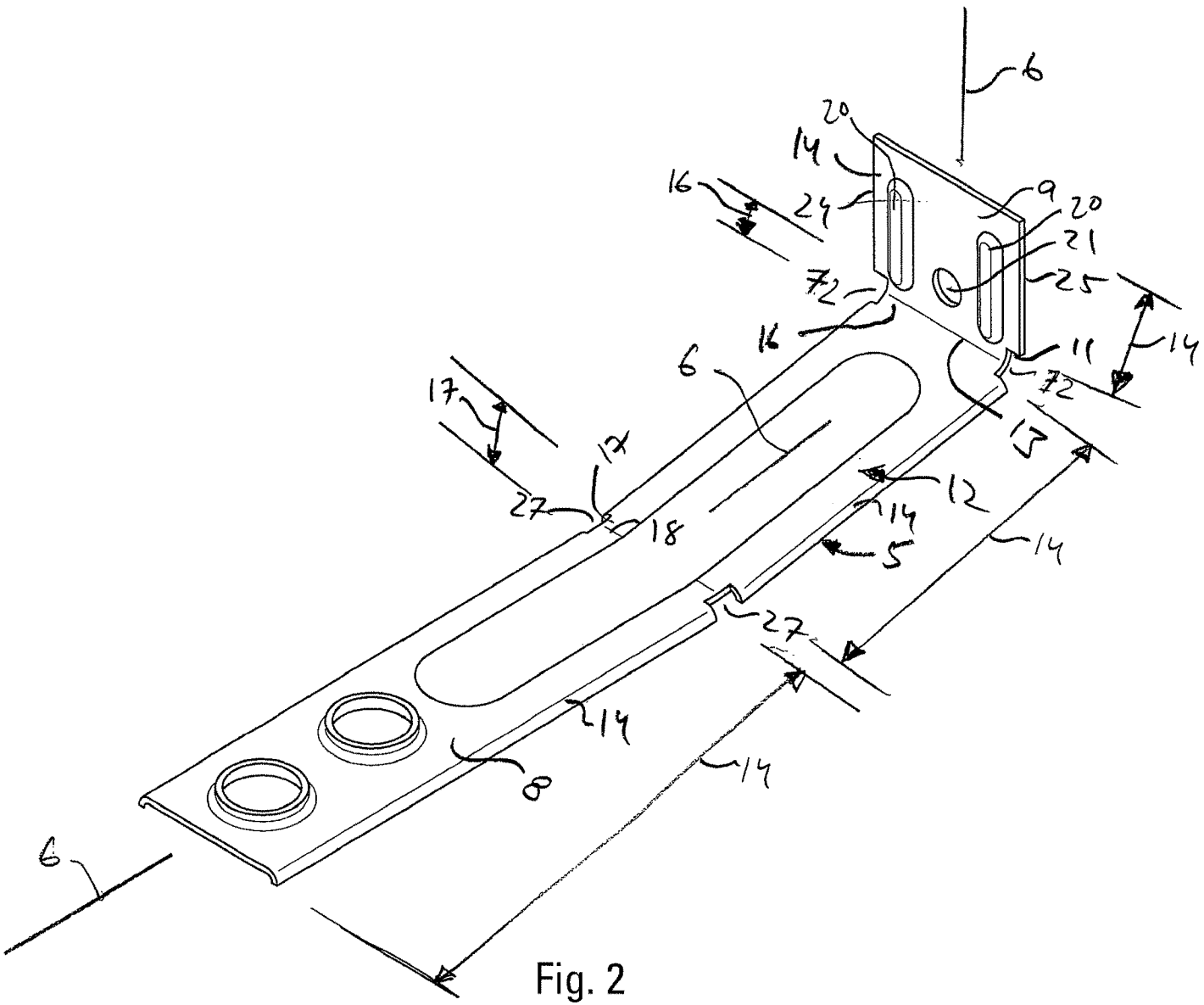
FIG. 2 is a perspective view of the connector of FIG. 1 bent into an alternate shape.
Figure 3:
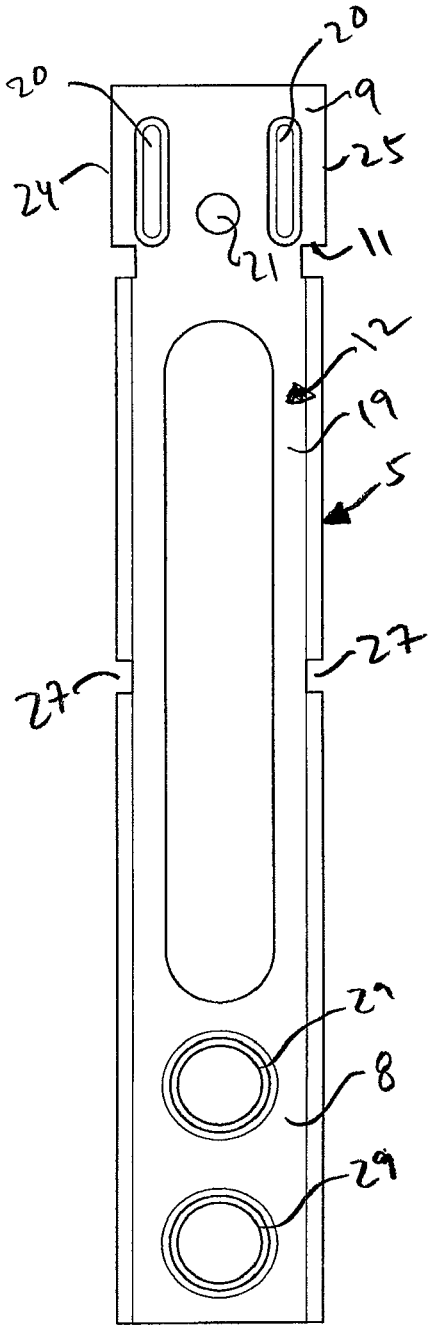
FIG. 3 is a top view of the connector of FIG. 1.
Figure 4:
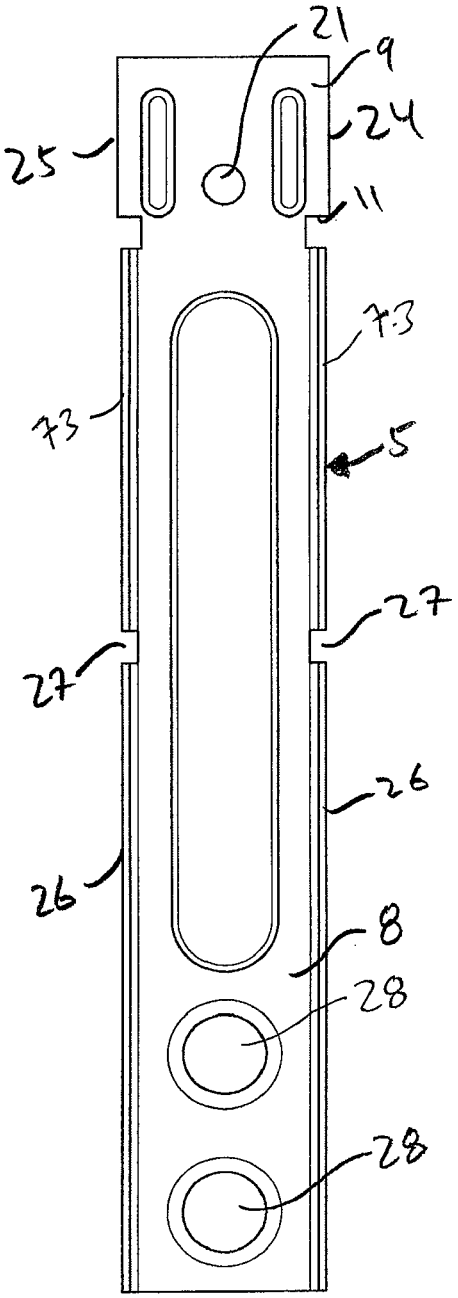
FIG. 4 is a bottom view of the connector of FIG. 1.
Figure 5:
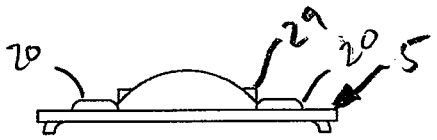
FIG. 5 is back end view of the connector of FIG. 1.
Figure 6:
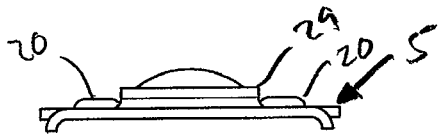
FIG. 6 is a front end view of the connector of FIG. 1.

In FIG. 2, the connector 5 is shown with a first bend 13 between the structural member attachment portion 9 and the extending portion 12. The connector 5 is also shown with a second bend 18 in the bridge portion 19 of the extending portion 12. The structural member attachment portion 9 is formed with a controlled stiffness zone 14. The portion of the extending portion 12 proximal to the structural member attachment portion 9 is formed with a controlled stiffness zone 14. Between the structural member attachment portion 9 and the extending portion 12, the connector 5 is formed with a controlled bending zone 16 at the first bend 13. The portion of the extending portion 12 distal to the structural member attachment portion 9 is formed with a controlled stiffness zone 14. Between the controlled stiffness zones 14 on the extending portion 12 there is preferably provided at least one calibrated stiffness zone 17 where a second bend 18 can be formed in the connector 5.

The controlled stiffness zone 14 in the structural member attachment portion 9 is preferably formed with two embossments 20 that run along the longitudinal axis 6 of the connector 5. The embossments 20 bracket an opening 21 for the fastener 7 that joins the connector 5 to the structural member 2.

Figure 7:
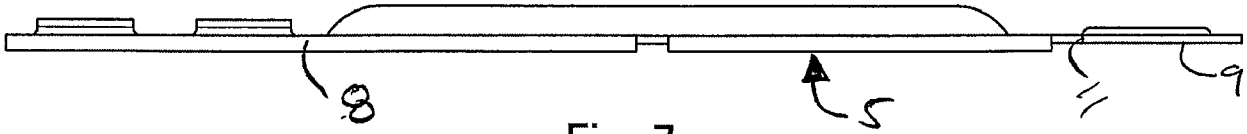
FIG. 7 is a side elevation view of the connector of FIG. 1.
Figure 8:
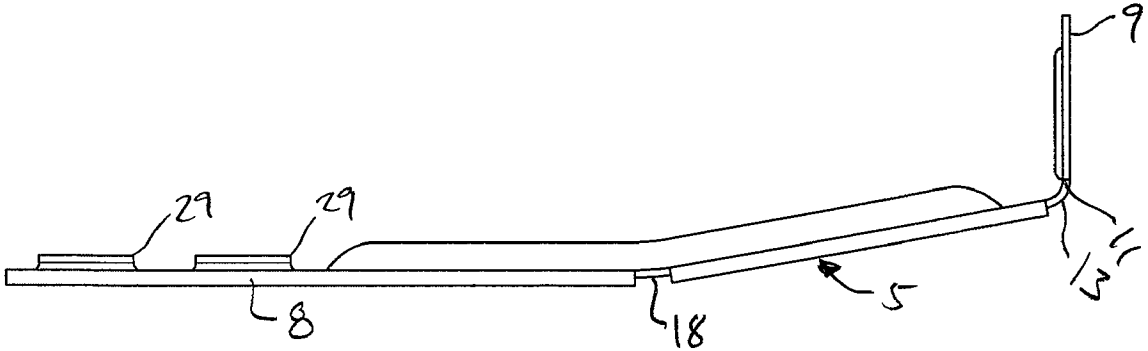
FIG. 8 is a side elevation view of the connector as bent and shown in FIG. 2.

Notches 72 could be formed on either side of the connector 5 at the first bend 13 to further make it easy to bend the connector 4 transverse to the longitudinal axis 6 at the controlled bending zone 16. As shown in FIGS. 7 and 8, the controlled bending zone is a thin portion along the longitudinal axis 6 where there are no strengthening portions 15 in the connector such that general flat metal of the connector 5 is easily bent.

Figure 14:
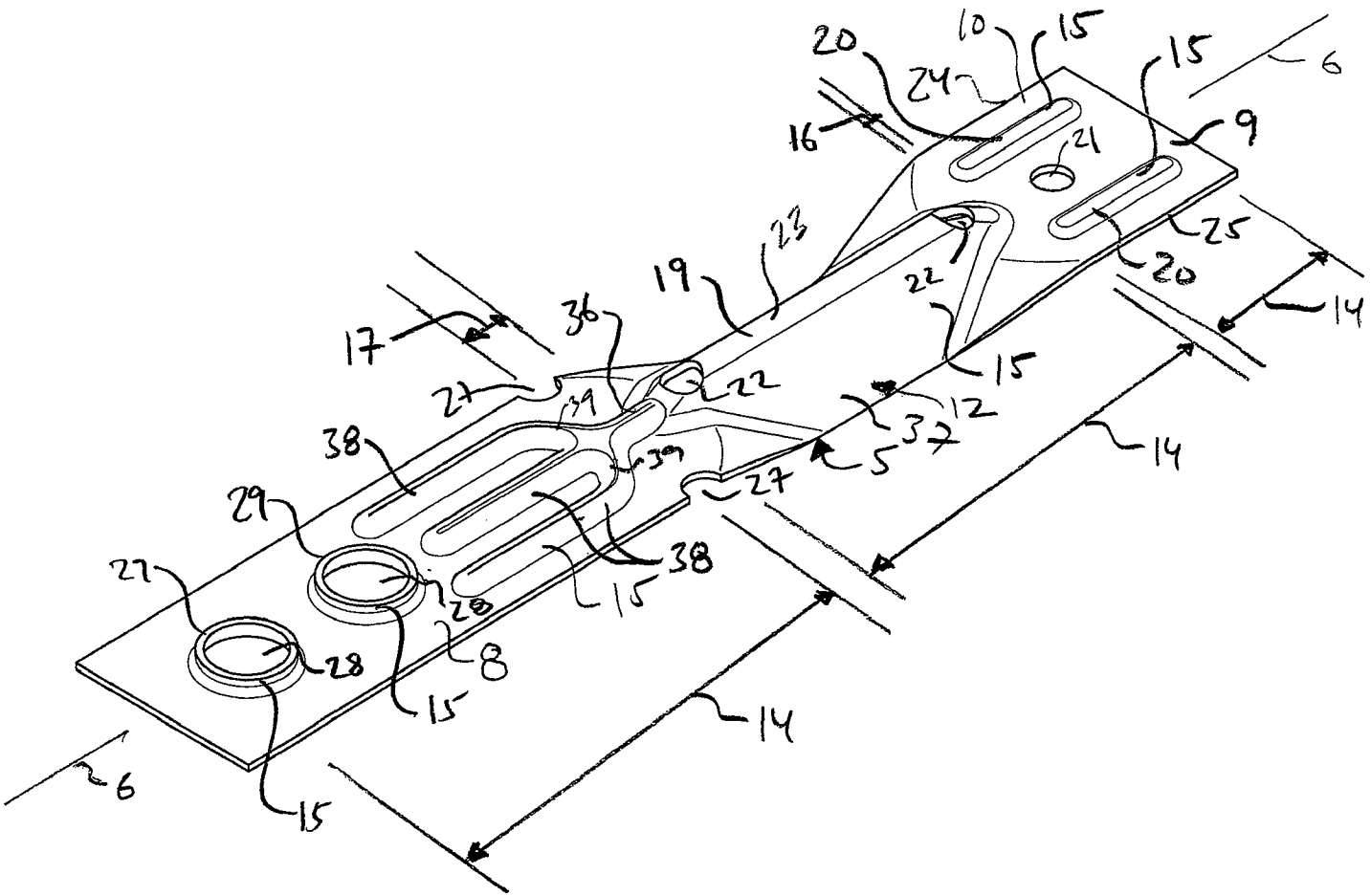
FIG. 14 is a perspective view of a connector according to the present invention.
Figure 15:
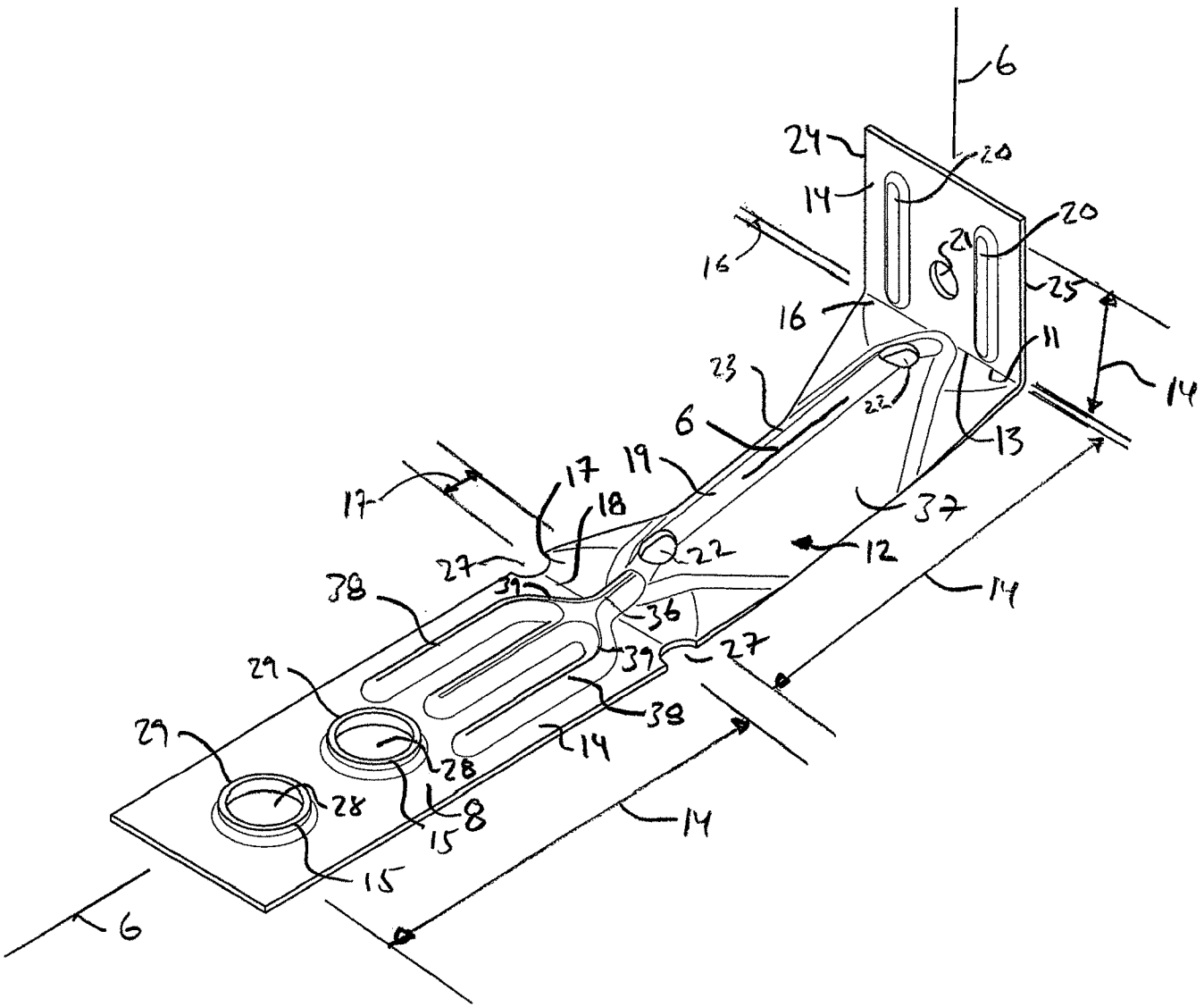
FIG. 15 is a perspective view of the connector of FIG. 14 bent into an alternate shape.
Figure 16:
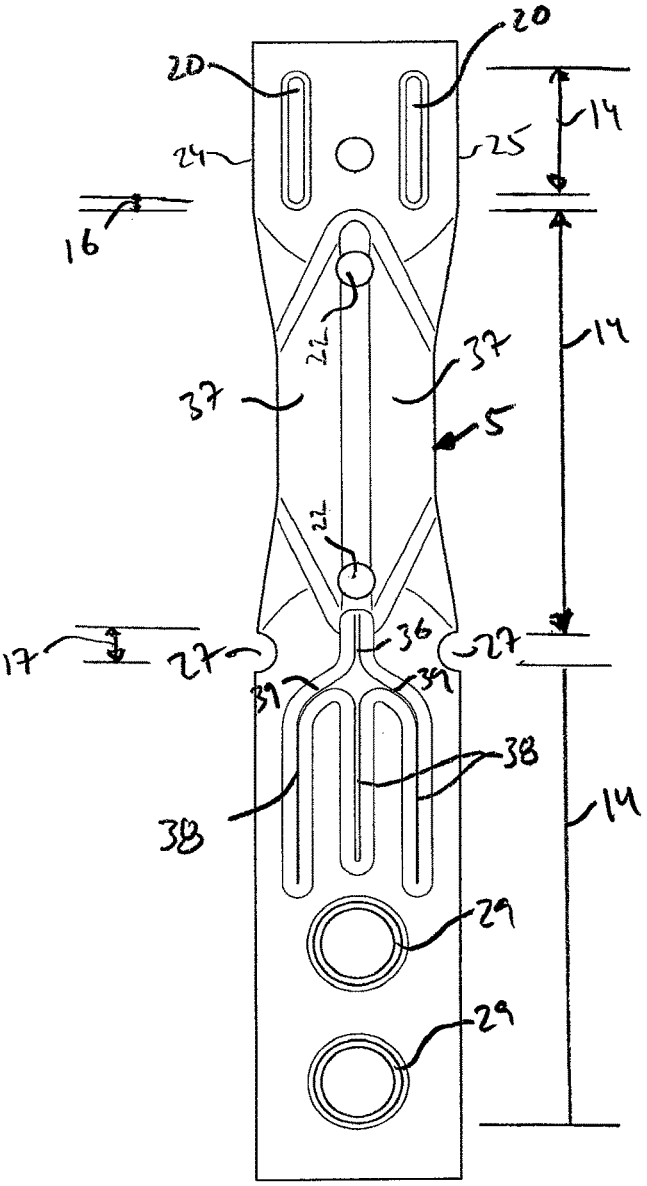
FIG. 16 is a top view of the connector of FIG. 14.
Figure 17:
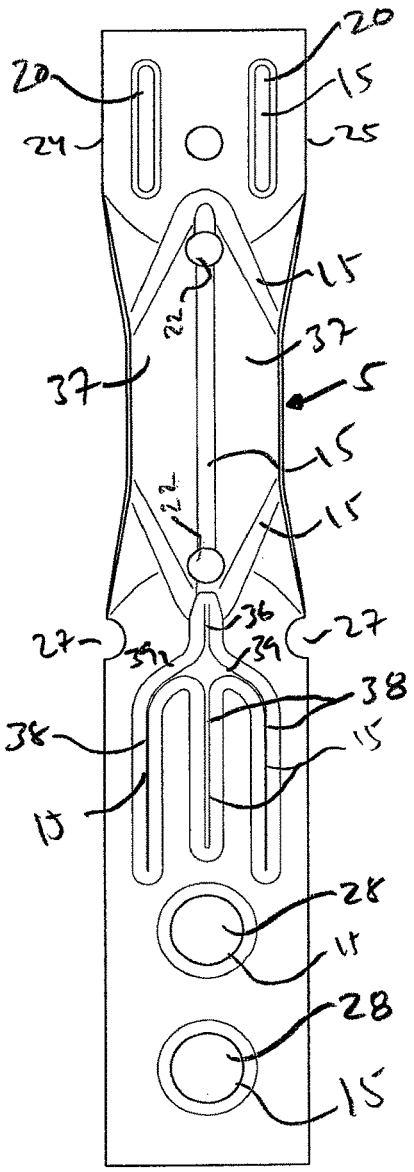
FIG. 17 is a bottom view of the connector of FIG. 14.
Figure 18:
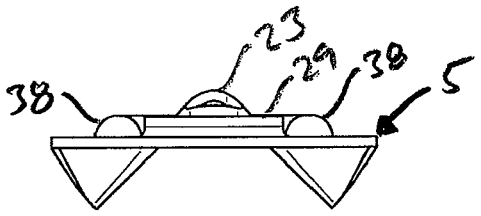
FIG. 18 is back end view of the connector of FIG. 14.
Figure 19:
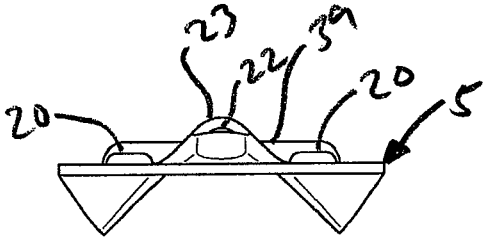
FIG. 19 is a front end view of the connector of FIG. 14.
Figure 20:
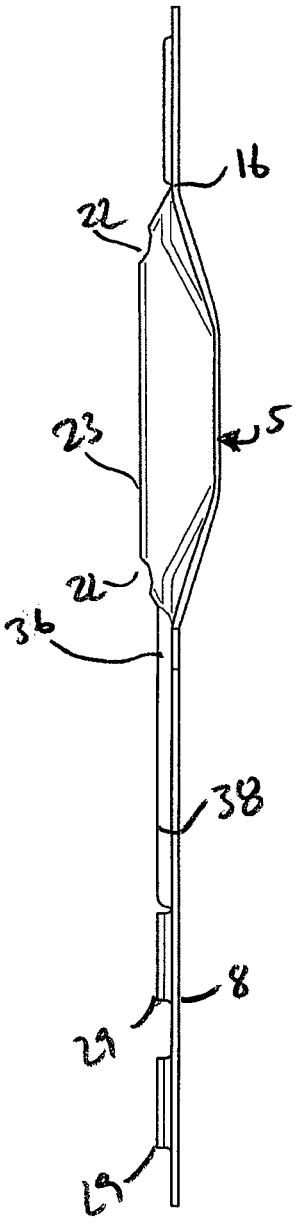
FIG. 20 is a side elevation view of the connector of FIG. 14.
Figure 21:
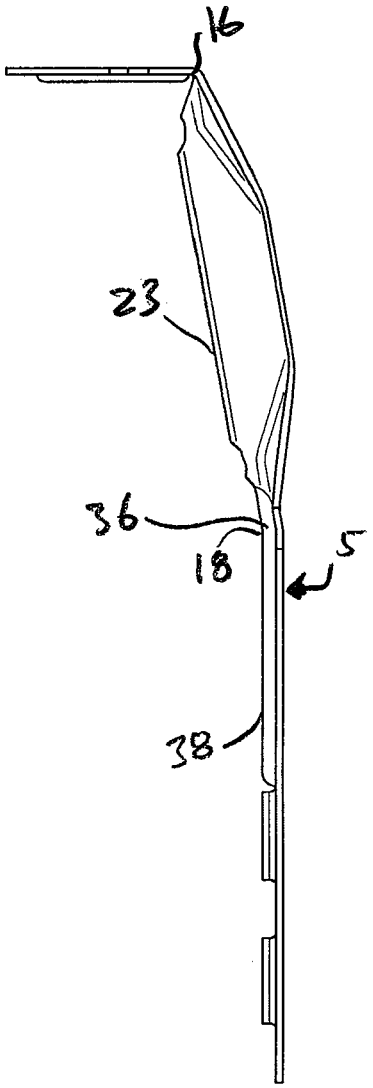
FIG. 21 is a side elevation view of the connector as bent and shown in FIG. 15.
Figure 22:
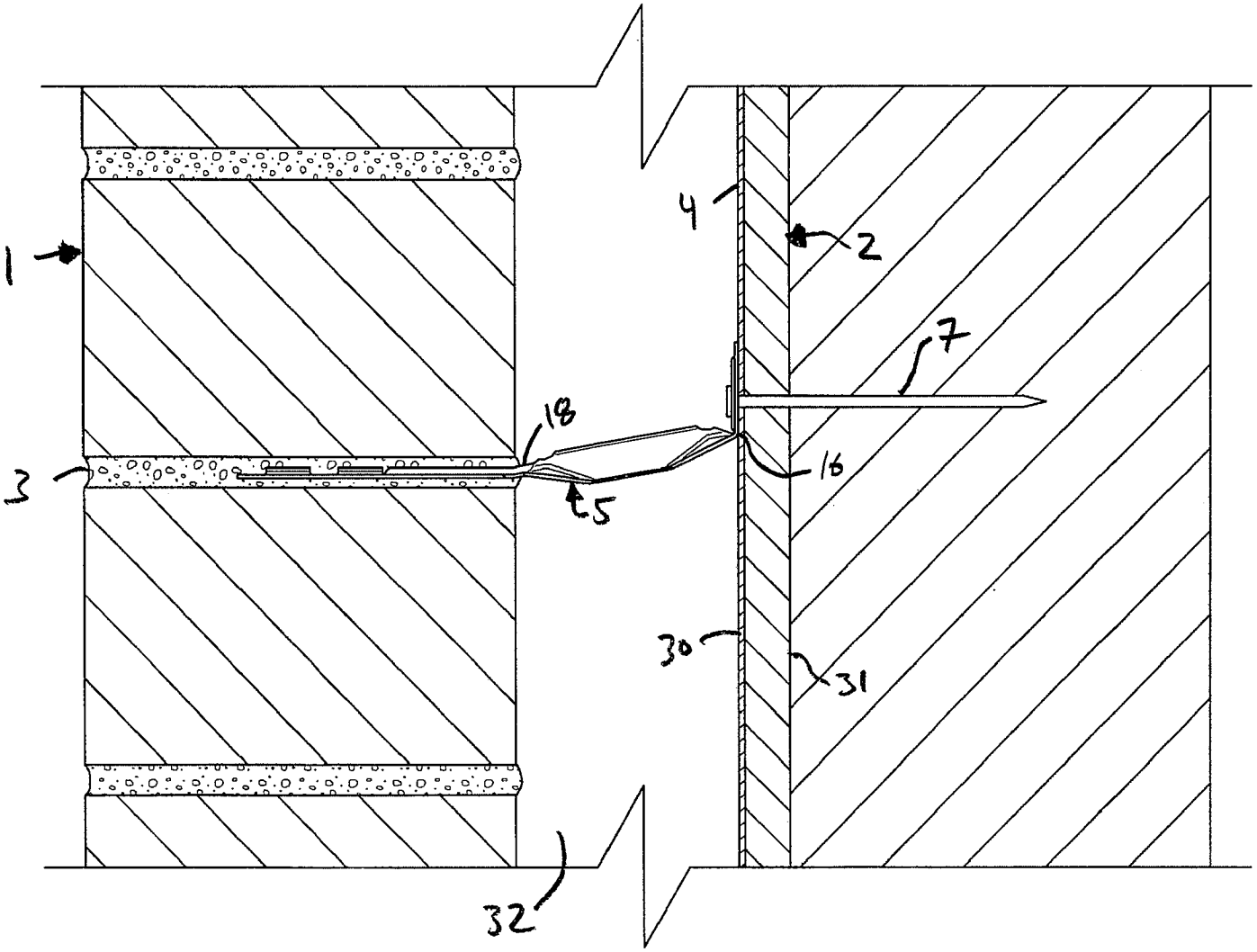
FIG. 22 is a side, cross-sectional view of the connection of the present invention, showing the connector bent into an alternate shape as in FIG. 15.

As shown in FIG. 14, the proximal portion of the extending portion 12 can be formed with a deep v-shaped embossment 23 to create a controlled stiffness zone. The v-shaped embossment 23 is formed with weep holes 22 to drain water from the connector. As shown in FIG. 1, the proximal portion of the extending portion 12 could be formed with flanges 73 at the side edges 24 and 25 of the connector 5 to create a controlled stiffness zone 17.

As shown in FIG. 1, the distal portion of the extending portion 12 could be formed with flanges 26 at the side edges 24 and 25 of the connector 5, creating another controlled stiffness zone 14. The flanges 26 extend along the mortar joint attachment portion 8.

At the second bend 18 in the connector 5, additional notches 27 are formed to allow for easier bending of the connector 5. The additional notches 27 interrupt the side edges 24 and 25 of the connector 5 in the extending portion 12. At the second bend 18 of the connector 5, the connector 5 is also provided with a connecting embossment 36 that extends beyond the additional notches 27 into the controlled stiffness zones 14 that bracket the second bend 18. This arrangement of portions makes the area of the connector 5 at the second bend 18 a calibrated stiffness zone 17.

As shown in FIGS. 1 and 2, the mortar joint attachment portion 8 is formed with openings 28 to allow mortar to extend through the connector 5. The edges of the openings 28 are provided with protruding rims 29 to help the connector 5 engage the mortar.

FIG. 9 shows the connection. The mortar joint attachment portion 8 is engaged with the mortar joint. The fastener 7 is driven into the structural member 2 which could be a stud in a structural wall. The structural wall that contains the structural member 2 is shown with a waterproof covering layer 30 and panel 31. A space 32 is provided between the wall 1 and the structural member 2.

Figure 25:
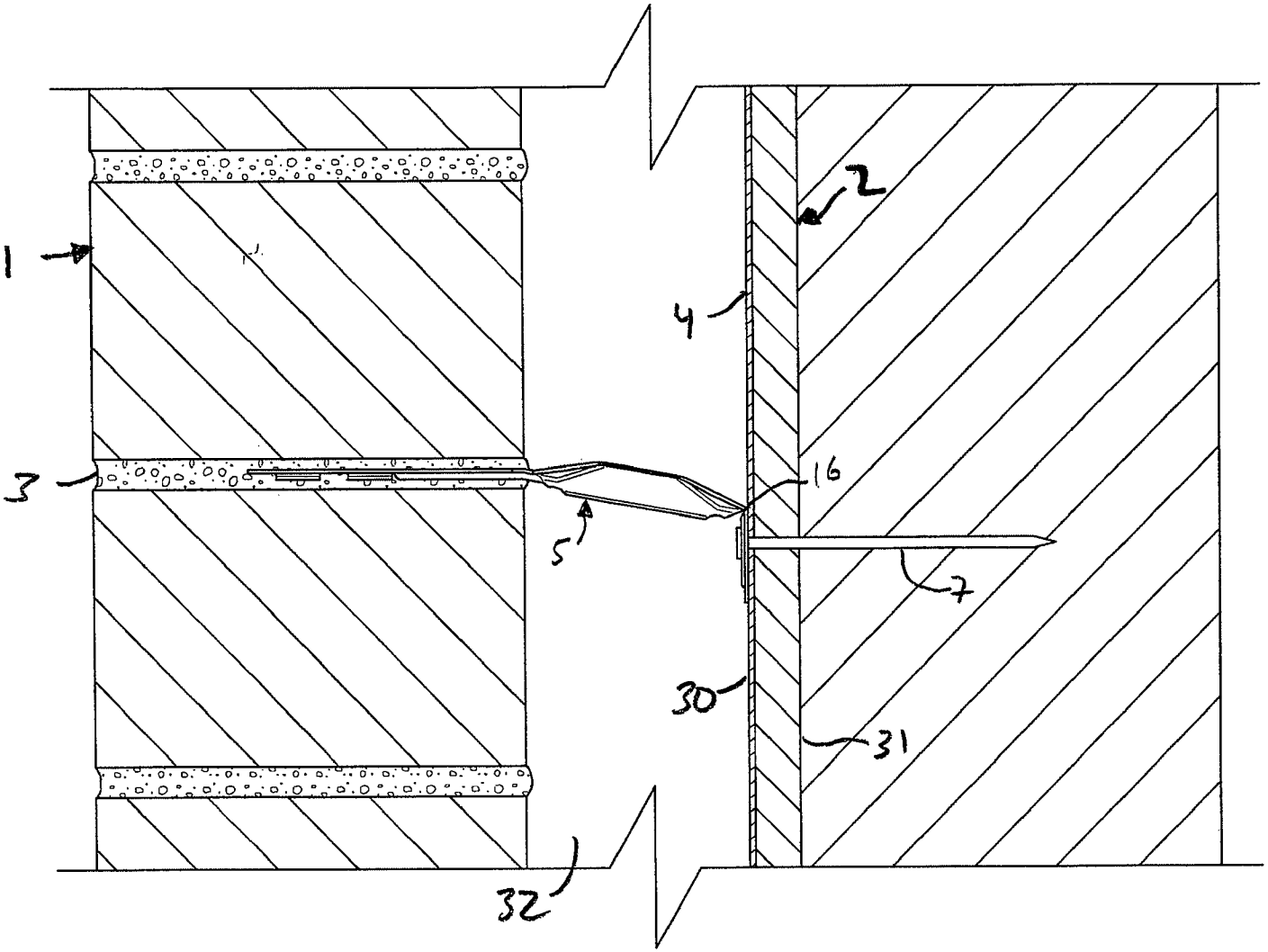
FIG. 25 is an alternate side, cross-sectional view of the connection of the present invention. The connector is inverted.
Figure 26:
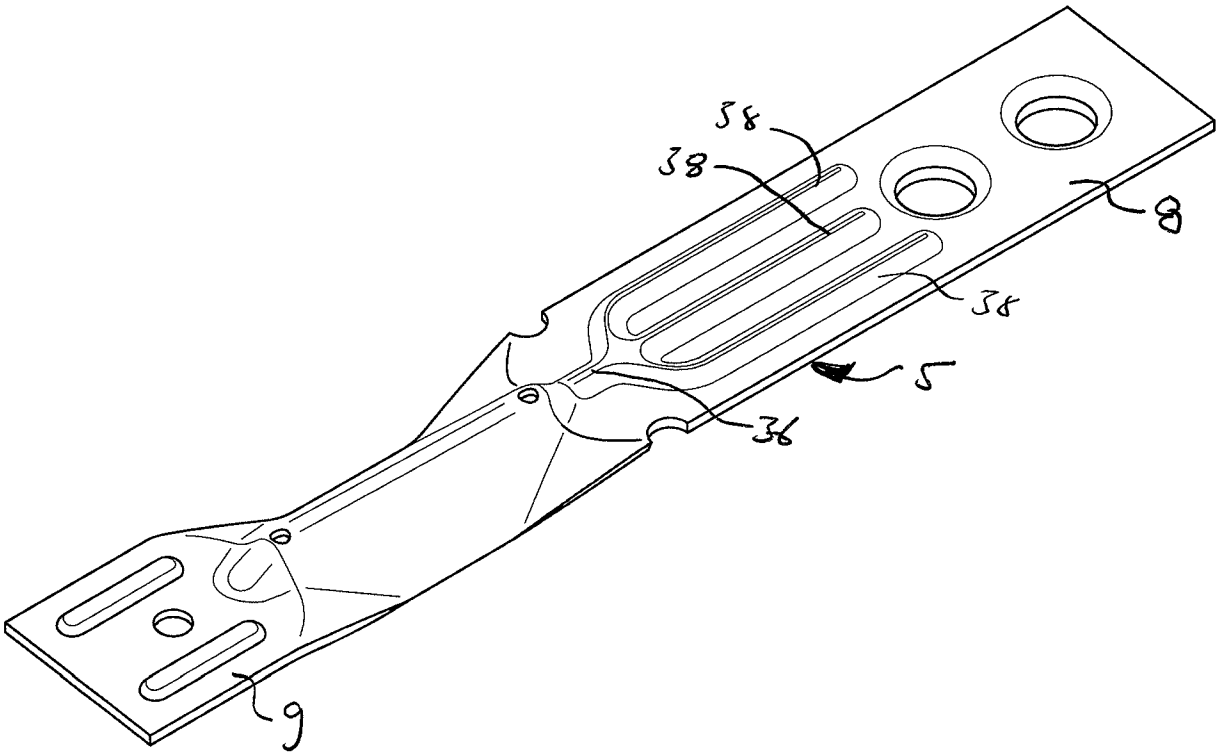
FIG. 26 is a perspective of an alternate connector according to the present invention.

As shown in FIG. 14, the bridge portion 19 can be formed with a large v-shaped embossment 23 to strengthen this portion of the extending portion 12 that is not inserted in the mortar joint 3 or attached to the structural member 2. Typically, the connector 5 will be installed with the vertex of the "v" of the embossment 23 disposed upwardly and the sides of the v-shaped embossment 37 extending downwardly. The orientation of the v-shaped embossment 23 allows the bridge portion 19 to shed water that may fall on the connector 5. The v-shaped embossment 23 is preferably formed with weep holes 22 or openings in the connector 5 that allow water to drain from the v-shaped embossment 23 when the connector 5 is installed in an inverted position as is shown in FIG. 25.

Figure 10:
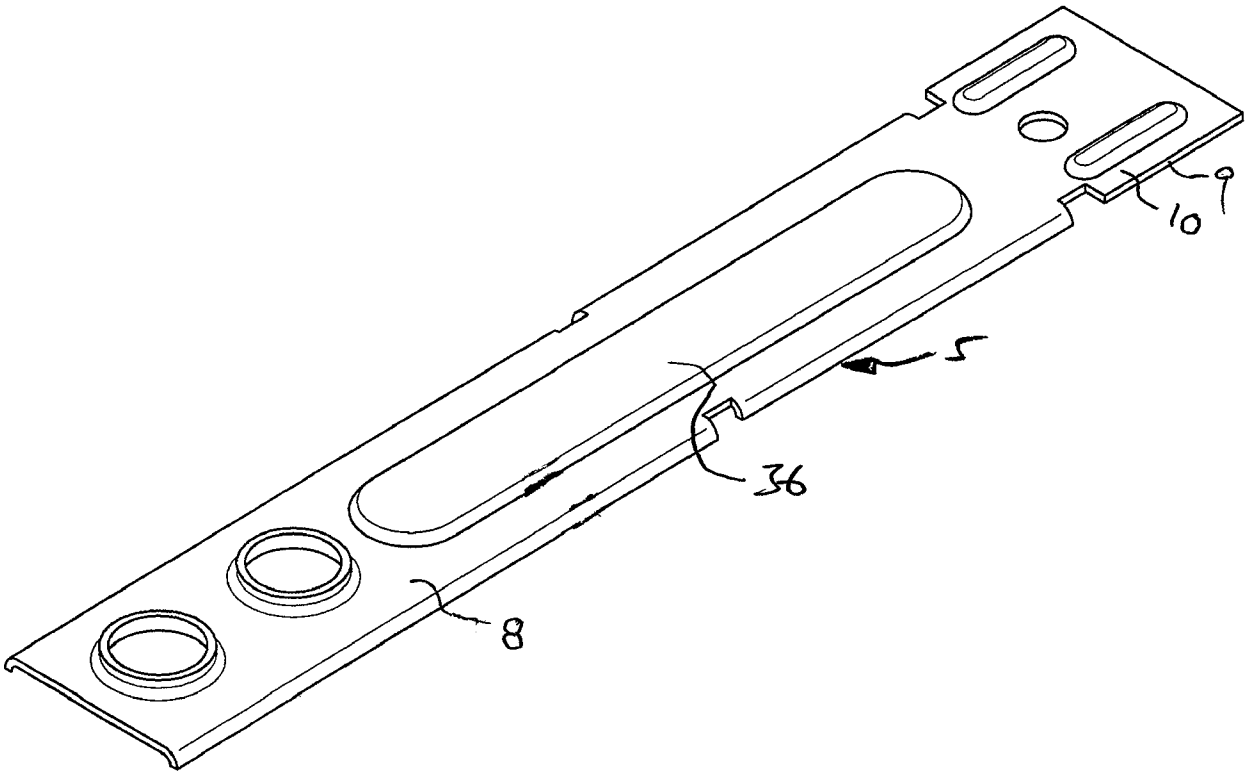
FIG. 10 is a perspective view of an alternate connector according to the present invention.
Figure 11:
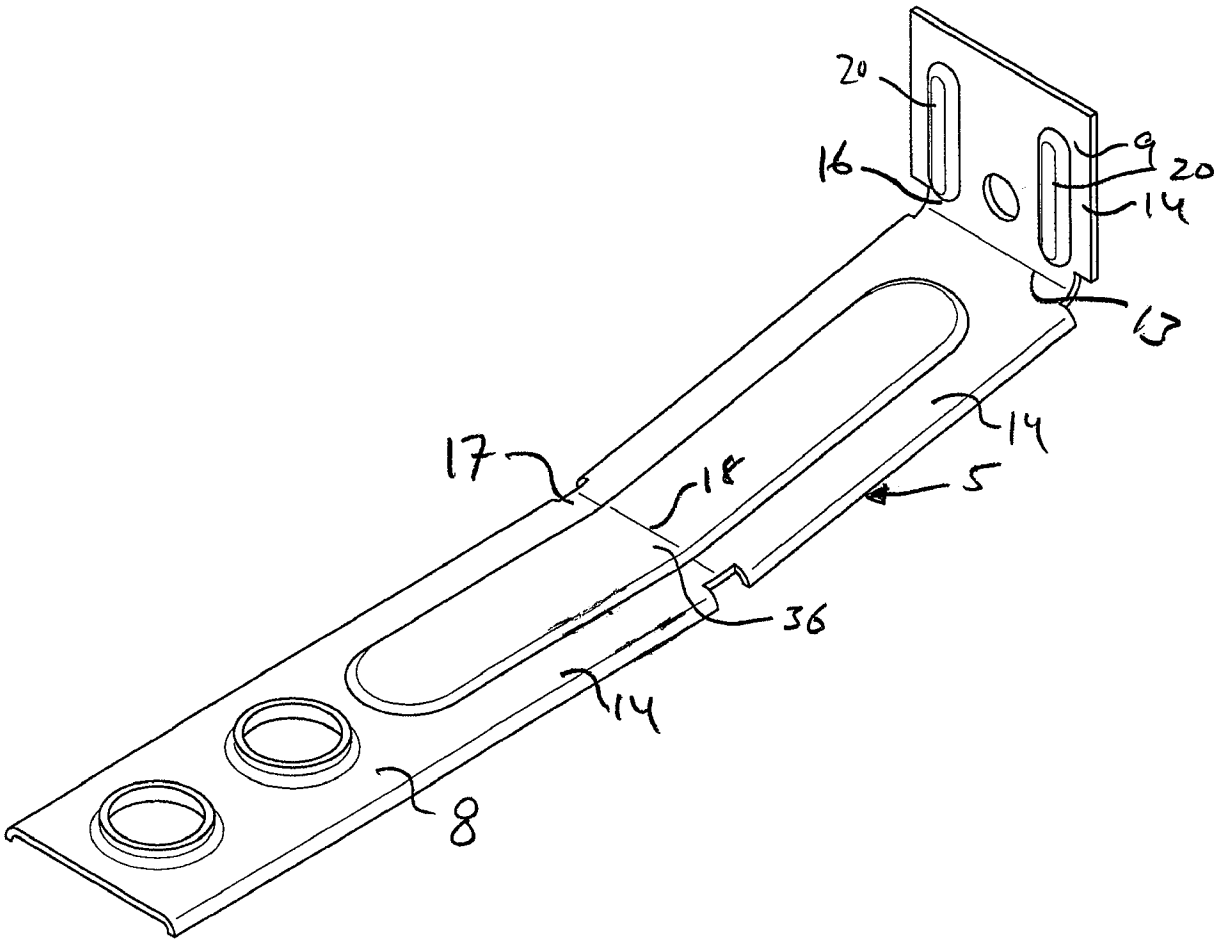
FIG. 11 is a perspective view of the connector of FIG. 10 bent into an alternate shape.
Figure 23:
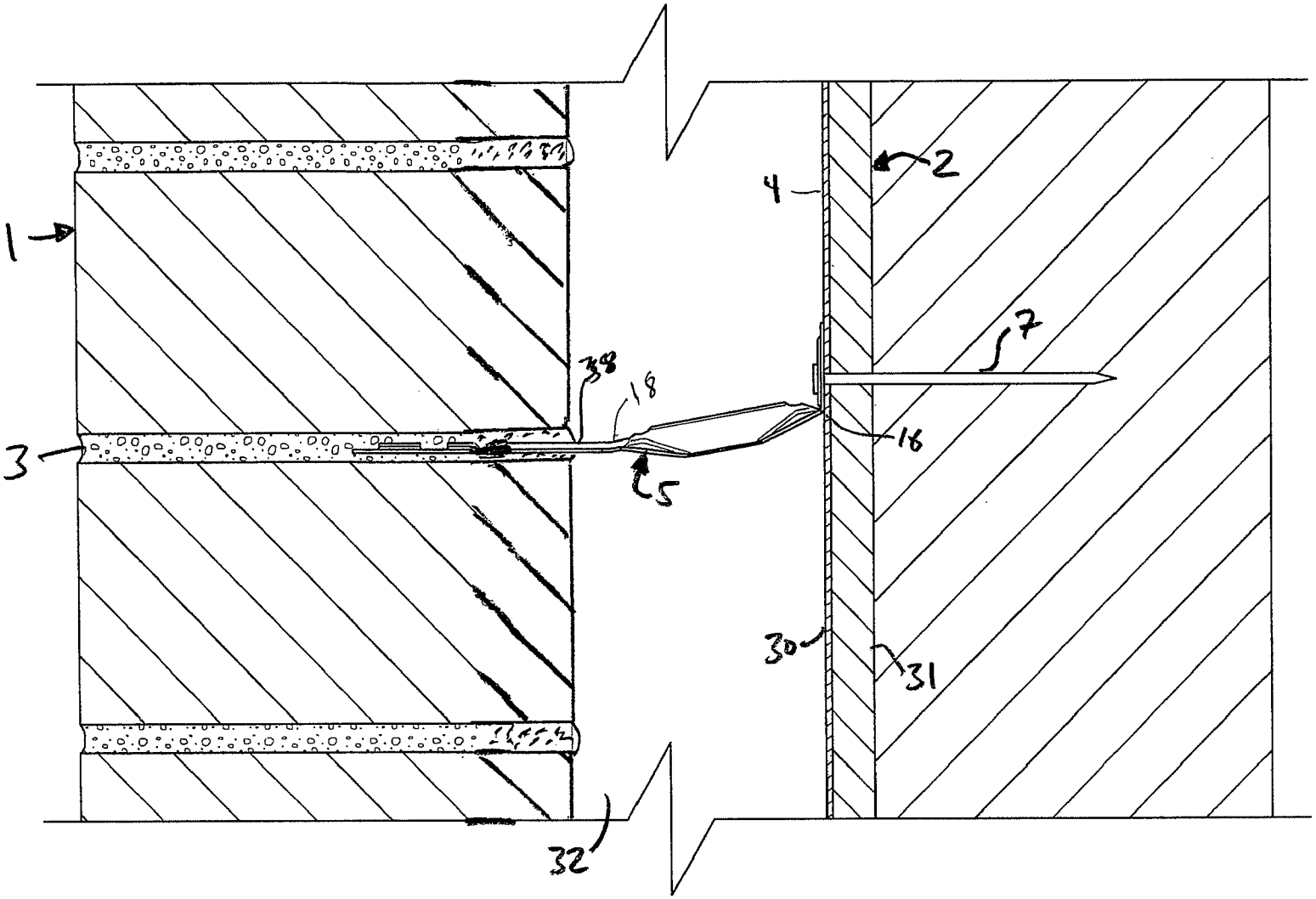
FIG. 23 is an alternate side, cross-sectional view of the connection of the present invention, showing the connector bent into an alternate shape as in FIG. 15.
Figure 24:
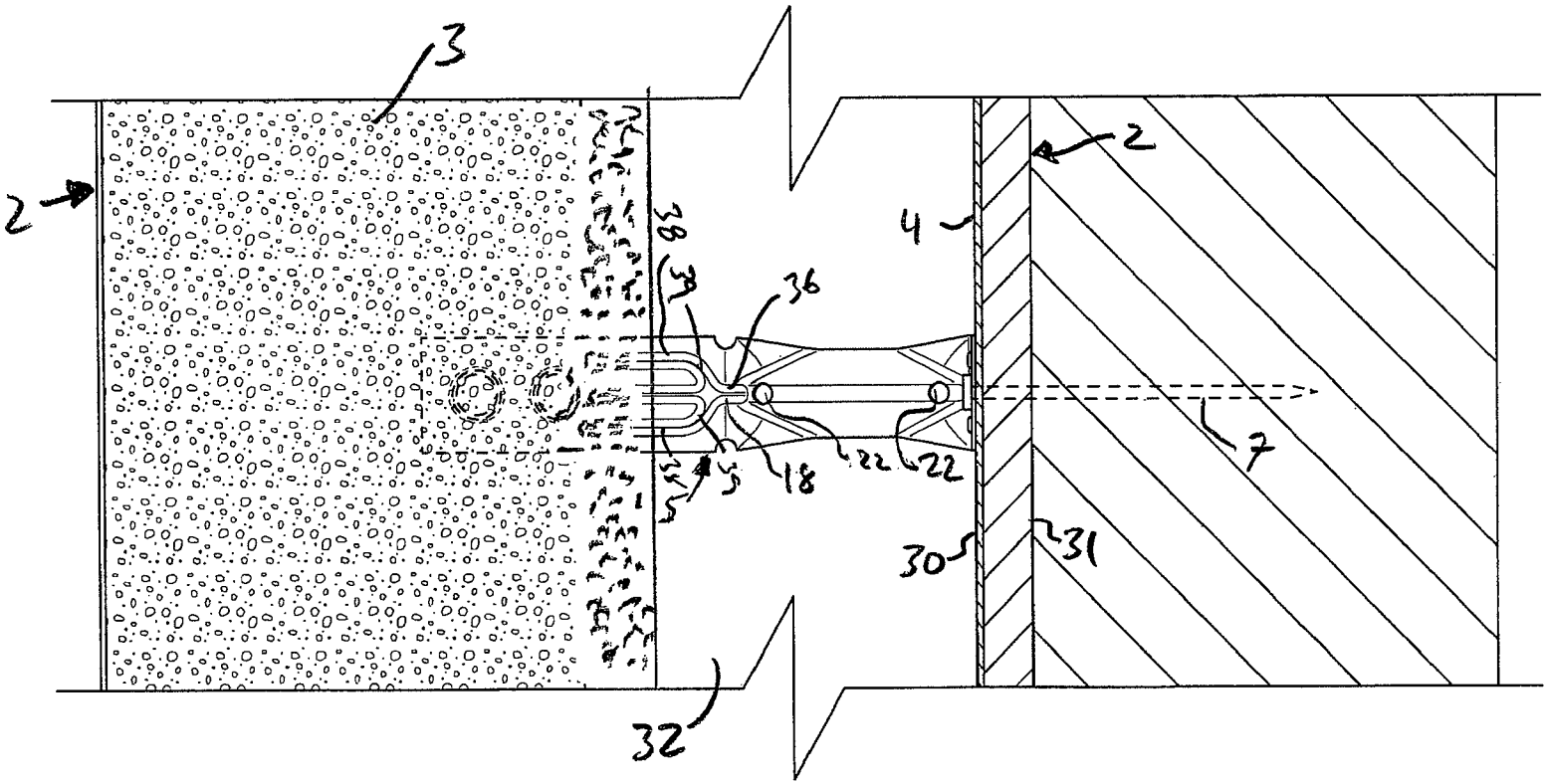
FIG. 24 is a top view of the connection of FIG. 23, showing portions of the mortar joint attachment portion protruding from the mortar joint.

As shown in FIG. 14, the mortar joint attachment portion 8 is preferably made with one or more generally parallel, thin extending embossments 38 that extend along the length of the axis 6 of the connector 5. The mortar joint attachment portion 8 is also provided with openings 28 for creating interlock with the mortar of the mortar joint 3. The extending embossments 38, of which there are three preferably, are disposed closer to the structural wall attachment portion 9 then the interlocking openings 28. As shown in FIGS. 10 and 11, portions of these extending embossments 38 can protrude from the mortar joint 3 in certain installations when the gap 32 between the brick wall 1 and the structural member 2 are spaced farther apart than typically, or if the connector 5 is bent substantially to have the mortar joint attachment portion 8 reach into the mortar joint 3. These one or more extending embossments 38 provide strength to those portions of the mortar joint attachment portion 8 that is not embedded in the mortar 3 in the installations shown in FIGS. 23 and 24.

According to the present invention, the extending embossments 38 in the mortar joint attachment portion 8 at their ends closer to the structural attachment portion 9 are preferably joined together by one or more angled transitioning embossments 39 that come together to form the one or more connecting embossments 36, preferably just one, that extend along the axis 6 of the connector from the mortar joint attachment portion 8 to the bridge portion 19 of the extending portion 12. These one or more connecting embossments 36 that extend from the mortar joint attachment portion 8 to the bridge portion 19 of the extending portion 12 are preferably fewer in number than the extending embossments 38 in the mortar joint attachment portion 8. These one or more connecting embossments 36 also extend into the bridge portion 19 that is formed with strengthening embossments 15 or bends. As shown in FIG. 1 this strengthening embossment is a deep v-shaped embossment 23. This extension of the one or more connecting embossments 36 creates a calibrated stiffness zone 17 between the mortar joint attachment portion 8 and the bridge portion 19 of the extending member 12. The one or more connecting embossments 36 and the one or more extending embossments 38 can be the same number, but the one or more connecting embossments 36 and the one or more extending embossments 38 in the mortar joint attachment portion 8 are formed such that it is easier to bend the connector 5 transverse to the axis 6 along the connector 6 at the calibrated stiffness zone 17 between mortar joint attachment portion 8 and the bridge portion 19. The one or more connecting embossments 36 and the strengthening formations 15 in the bridge portion 19 are formed such that it is easier to bend the connector transverse to the axis along the connector at the calibrated stiffness zone 17 between the mortar joint attachment portion 8 and the bridge portion 19.

According to the present invention, the extending embossments 38 in the mortar joint attachment portion 8 are connected by the one or more transitioning embossments 39 to the one or more connecting embossments 36, and the one or more connecting embossments 36 extend into the v-shaped embossment 23 in the bridge portion 19. This connection of the embossments creates a gutter system that will transfer water off of the connector 5 via the weep holes 22 in the v-shaped embossment 23 if the connector is disposed in an inverted position as shown in FIG. 12.

The particular elements used to strengthen the connector 5 and give the connector 5 its characteristic properties also allow the connector 5 to be made with less material which reduces the cost of the connector 5. These elements include making the bridge portion 19 with a single v-shaped embossment 23 that extends the width of the connector 5, making the mortar joint attachment portion 8 with three parallel thin extending embossments 38 and making the mortar joint attachment potion 8 with rimmed openings 29.

Figure 12:
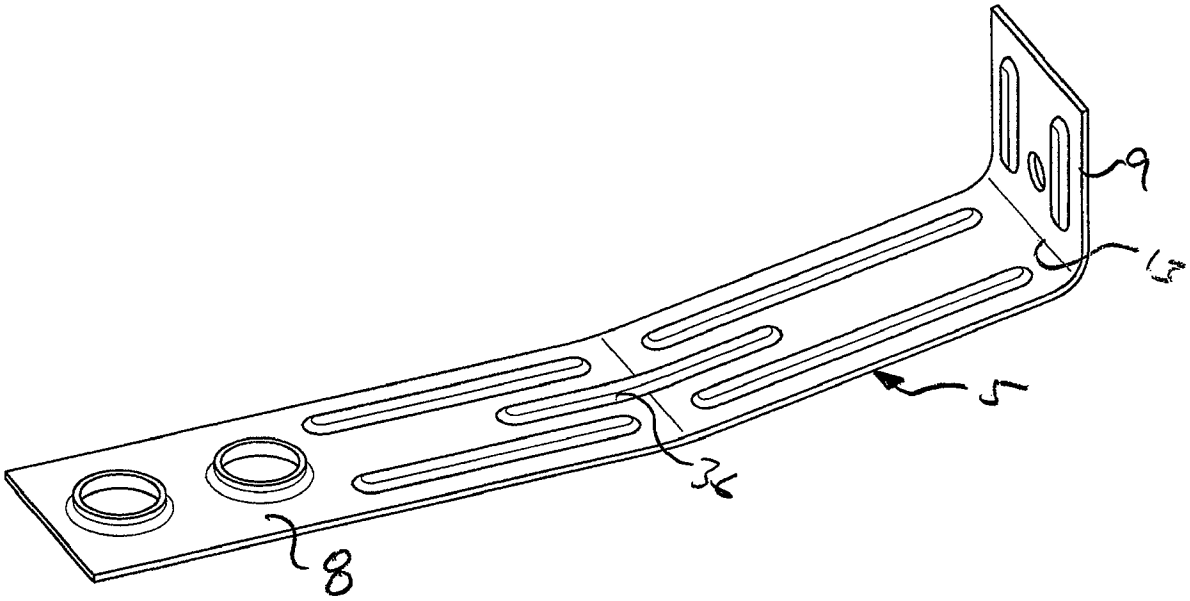
FIG. 12 is a perspective of an alternate connector according to the present invention.

FIG. 12 shows a similar connector 5 with a smaller central embossment 36 in the extending portion 12 and without any notches.

Figure 13:
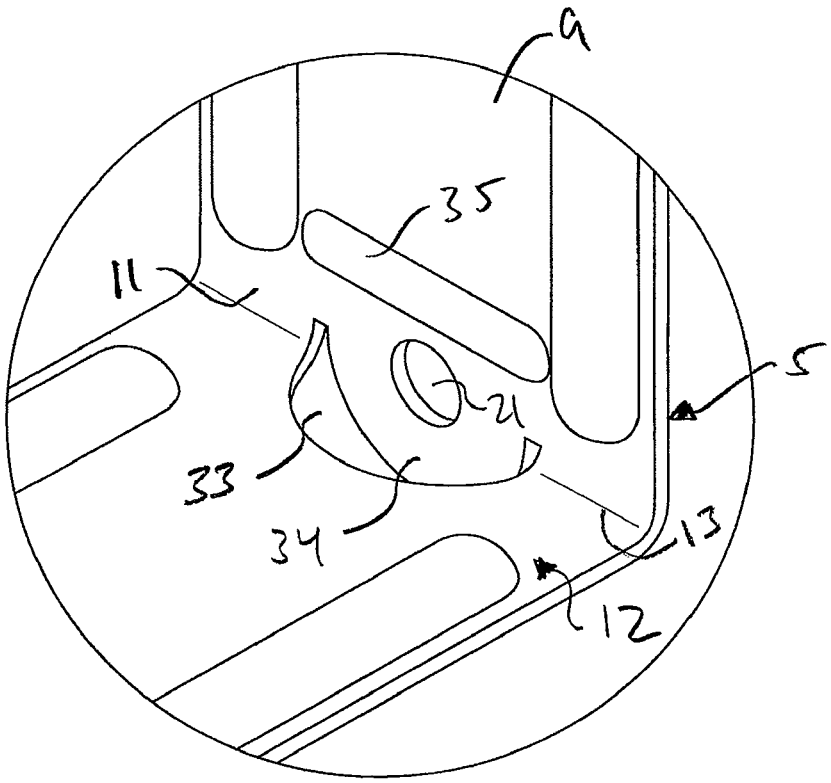
FIG. 13 is a perspective view of an alternate arrangement of the connector according to the present invention.

FIG. 13 shows a central notch 33 in the extending portion 12, creating a tab 34 that extends from the end 11 of the main body 10 of the structural member attachment portion 9. The opening 21 for the fastener 7 is provided in this tab 34 such that the opening 21 for the fastener 7 is aligned with the first bend 13. An additional embossment 35 is provided in the structural member attachment portion 9.

We claim:

1. A connection between a wall having a mortar joint and a structural member made with a connector, the connection comprising:

a. the wall having the mortar joint;

b. the structural member having a substantially vertically disposed surface, c. the connector, the connector having a mortar joint attachment portion at least a portion of which is received in the mortar joint of the wall and a structural member attachment portion attached to the structural member, the structural member attachment portion has a main body and at the end of the main body the structural member attachment portion is joined to an extending portion, the extending portion extending away from the substantially vertically disposed surface of the structural member and extending to the wall having the mortar joint, the extending portion including the mortar joint attachment portion, the connector having a longitudinal axis that extends along the mortar joint attachment portion and to and along the structural member attachment portion, wherein;

d. the connector includes one or more controlled stiffness zones where the connector is formed with one or more strengthening portions, one or more controlled bending zones where the connector is adapted to be more easily bent transversely to the longitudinal axis than the connector is bent transversely to the longitudinal axis in the one or more controlled stiffness zones, and one or more calibrated stiffness zones where the connector is adapted to be bent more easily than the connector is bent in the one or more controlled stiffness zones transversely to the longitudinal axis and where the connector is adapted to be bent less easily than in the one or more controlled bending zones transversely to the longitudinal axis.

2. The connection of claim 1, wherein:

the structural member attachment portion interfaces with and is attached to the substantially vertically disposed surface of the structural member.

3. The connection of claim 1, wherein:

one or more bends transverse to the axis of the connector are formed in the connector in the one or more controlled bending zones.

4. The connection of claim 1, wherein:

one of the one or more controlled bending zones is provided between the structural member attachment portion and the extending portion and has a bend.

5. The connection of claim 4, wherein:

the connector is formed with a fastener opening in the structural member attachment portion close to the bend between the extending portion and the structural member attachment portion.

6. The connection of claim 1, wherein:

one or more bends transverse to the axis of the connector are formed in the connector in the one or more controlled stiffness zones.

7. The connection of claim 1, wherein:

the one or more calibrated stiffness zones are bracketed by at least two of the one or more controlled stiffness zones.

8. The connection of claim 1, wherein:

the one or more calibrated stiffness zones are provided in the extending portion of the connector.

9. The connection of claim 1, wherein:

a. the wall is separated from the structural member such that there is a space between the structural member and the wall; and b. the one or more calibrated stiffness zones are provided in the extending portion of the connector that is disposed in the space between the structural member and the wall.

10. The connection of claim 1, wherein:

at least one of the one or more strengthening portions extends from one of the one or more controlled stiffness zone into one of the one or more calibrated stiffness zones.

11. The connection of claim 1, wherein:

the mortar joint attachment portion has one or more strengthening portions that extend along the longitudinal axis of the connector.

12. The connection of claim 11, wherein:

the one or more strengthening portions are generally parallel, thin extending embossments.

13. The connection of claim 12, wherein:

the one or more extending embossments have ends closer to the structural attachment portion and are joined together by one or more angled transitioning embossments that come together to form one or more connecting embossments.

14. The connection of claim 13, wherein:

the one or more connecting embossments extend through at least one of the one or more calibrated stiffness zones in the extending portion.

15. The connection of claim 14, wherein:

a. the wall is separated from the structural member such that there is a space between the structural member and the wall; and b. portions of the one or more strengthening portions are provided in the extending portion of the connector that is disposed in the space between the structural member and the wall;

c. the one or more connecting embossments extend to the strengthening portions provided in the extending portion of the connector that is disposed in the space between the structural member and the wall.

16. The connection of claim 15, wherein:

one of the one or more strengthening portions having a portion that is disposed in the space between the structural member and the wall is formed with an opening through the connector.

17. The connection of claim 11, wherein:

a. the wall is separated from the structural member such that there is a space between the structural member and the wall; and b. portions of the one or more strengthening portions are provided in the extending portion of the connector that is disposed in the space between the structural member and the wall; and c. portions of the strengthening portions are provided in the mortar joint.

18. The connection of claim 17, wherein:

the one or more strengthening portions with portions in the mortar joint and portions in the extending portion of the connector that is disposed in the space between the structural member and the wall are generally parallel, thin extending embossments.

19. The connection of claim 1, wherein:

a. the wall is separated from the structural member such that there is a space between the structural member and the wall; and b. the one or more calibrated stiffness zones are provided only in the extending portion of the connector that is disposed in the space between the structural member and the wall.

20. The connection of claim 19, wherein:

the one or more calibrated stiffness zones are bracketed by at least two of the one or more controlled stiffness zones.

* * * * *